US008992693B2

(12) United States Patent
Currell et al.

(10) Patent No.: US 8,992,693 B2
(45) Date of Patent: Mar. 31, 2015

(54) CLEANING STATION

(75) Inventors: James B. Currell, Cinnaminson, NJ (US); Anthony Severino, Moorestown, NJ (US)

(73) Assignee: Bio Brands, LLC, Holderness, NH (US)

( * ) Notice: Subject to any disclaimer, the term of this patent is extended or adjusted under 35 U.S.C. 154(b) by 1197 days.

(21) Appl. No.: 12/924,137

(22) Filed: Sep. 21, 2010

(65) Prior Publication Data

US 2012/0067369 A1 Mar. 22, 2012

(51) Int. Cl.

| | |
|---|---|
| ***B08B 3/04*** | (2006.01) |
| ***B08B 1/00*** | (2006.01) |
| ***B08B 3/00*** | (2006.01) |
| ***B08B 3/08*** | (2006.01) |

(52) U.S. Cl.

CPC ..... *B08B 1/002* (2013.01); *B08B 3/006* (2013.01); *B08B 3/08* (2013.01); *A46B 2200/30* (2013.01)

USPC ..... 134/31; 134/10; 134/38; 134/104.2; 134/137

(58) Field of Classification Search

None

See application file for complete search history.

(56) References Cited

U.S. PATENT DOCUMENTS

| | | | | |
|---|---|---|---|---|
| 3,762,952 | A | 10/1973 | Gouin et al. | |
| 3,865,628 | A | 2/1975 | Callahan et al. | |
| 4,056,114 | A * | 11/1977 | Boutillette | 134/104.4 |
| 4,439,884 | A | 4/1984 | Giorni | |
| 4,819,678 | A * | 4/1989 | Nolan | 134/186 |
| 4,995,409 | A * | 2/1991 | Watts | 134/58 R |
| 5,259,993 | A | 11/1993 | Short | |
| 5,582,650 | A | 12/1996 | Simons | |
| 5,652,993 | A | 8/1997 | Kreyer | |
| 6,393,648 | B1 | 5/2002 | Reynolds | |
| 6,453,918 | B2 * | 9/2002 | Cardemon | 134/135 |
| 7,200,891 | B1 | 4/2007 | McCulloch et al. | |
| 7,640,941 | B2 | 1/2010 | Watters et al. | |
| 2002/0152568 | A1 | 10/2002 | Dillinger | |
| 2004/0261819 | A1 | 12/2004 | Farnoush et al. | |
| 2005/0273957 | A1 | 12/2005 | Boltryk | |
| 2007/0221260 | A1 | 9/2007 | Watters et al. | |
| 2008/0257384 | A1 | 10/2008 | Farrell | |
| 2009/0139042 | A1 | 6/2009 | Ruzumna | |

* cited by examiner

*Primary Examiner* — Michael Kornakov
*Assistant Examiner* — Ryan Coleman
(74) *Attorney, Agent, or Firm* — Frank J. Bonini, Jr.; John F. A. Earley, III; Harding, Earley, Follmer & Frailey, P.C.

(57) ABSTRACT

A cleaning station that includes a container designed to hold a solvent and having a floor and two pairs of side walls connected to form an enclosure, with a first shelf disposed at a location elevated in relation to the container floor and a second shelf disposed above the first shelf, the second shelf being slidable and being removably provided, there being brushes located in an opening in the first shelf that may be used for cleaning tools and a plurality of additional openings in the first shelf to allow the passage of solvent.

9 Claims, 3 Drawing Sheets

CLEANING STATION

BACKGROUND OF THE INVENTION

1. Field of the Invention

The present invention relates to the field of cleaning

2. Brief Description of the Related Art

The use of resins, such as, for example, epoxy resin, polyester resin and vinylester resin, are common throughout a number of industries to provide coatings, surfaces or other structure to a component. The construction of marine craft often uses resins that are applied to cover a surface or in conjunction with fibers like fiberglass or carbon fiber to make the structure or parts. The application of resins often involves the use of tools, such as, for example, hand tools, tool heads, bubble rollers, shaping tools, scissors, chopper guns and other implements that come in direct contact with catalyzed resin that must be cleaned of resin before it cures rendering the tools useless. The resin must be cleaned from the tool, so the tool may be reused. In many cases, solvents are used to dissolve, loosen or remove the resin product from the tool. Resin application tools may include rollers, scissors, knives, spatulas, trowels and brushes.

One way of cleaning resin from tools is to use a solvent. Though acetone is a solvent that has been widely used for such purposes, it is very volatile and flammable, and therefore, storing quantities of acetone has inherent risks. In addition, acetone has drawbacks because it may contain traces of material that are hazardous to those who come in contact with it, is environmentally unfriendly and generally requires hazardous material disposal compliance. A method of removing polyester resins is disclosed in U.S. Pat. No. 5,582,650, entitled, "Process for Cleaning Parts Soiled or Encrusted with Polyester Resin". The '650 patent discloses a process for cleaning cured and partially cured polyester resins from tools, machinery, containers and the like, and involves four stages, each having one or more steps, including a pre-wash, an ultra-sonic wash stage, a rinse stage, and a drying stage. U.S. Pat. No. 3,865,628 relates to a "Removal of Polymer Residue from Surfaces of Processing Equipment" and discloses a process for removing a polymer residue from the surfaces of processing equipment used in the manufacture of terephthalate polyesters by contacting the surfaces with an aqueous solution which is at least 180° F. The equipment is then rinsed with water which is at least 160° F.

Tools used to apply material, such as, for example, resin application tools, require cleaning if they are to be re-used. Cleaning often involves removing the excess material that remains on the tool after its use. In the case of paint brushes, U.S. Pat. No. 7,200,891, entitled "Tool Cleaning Brush Assembly", discloses a device for cleaning a variety of hand tools, where cleaning brushes are mounted within a container.

U.S. Pat. No. 5,652,993 relates to a "Knife Cleaner" and discloses a device comprising a container filled with solvent that has a brush suspended within the container. The brush also is submerged in the solvent. The '933 device is described to be an improvement over the previous method of wiping the ink off a knife with a solvent saturated towel.

U.S. published application no. 2008/0257384 relates to a "Bucket Arrangement and Method of Using the Same" and discloses an apparatus for cleaning tools, utensils, and other objects. The wiping element is submerged in a liquid in the container to facilitate removal of undesirable material from the object. The '384 method involves a two step process. First, the object wipes against the first wiping element while submerged in the liquid, and then the object wipes against the second wiping element after being at least partially removed from the liquid. The '384 method was developed to reduce injuries from cuts or abrasions from contact with the object and is described to be more sanitary than previous systems.

U.S. published application no. 2004/0261819 relates to a "Coating Bush Cleaning and Storing Apparatus and Method" and discloses a brush cleaning and storing apparatus. The '819 device is disclosed to be useful for storing paint and coating brushes and brushes of like material. The '819 brush cleaning device provides a cleaning plate with a roughened grid or surface pattern, which is mounted on a plurality of posts that are secured to the base of the container. Solvent is then introduced into the container to at least a point above the irregular surface pattern. Then the brush is submerged into the solvent and rubbed against the irregular surface pattern which cleans the brush.

U.S. published application no. 2002/0152568 relates to a "System and Method for Cleaning Both the Interior and the Exterior of Drywall Tools" and discloses a standard bucket, preferably with a 5-gallon capacity, with brushes rigidly mounted to a metal frame in an orthogonal arrangement such that all of the bristles extend radially inward towards the center of the generally cylindrical frame, which is then placed inside the bucket. There is also a foot-actuated pump that is attached to the bucket and to the inlet port of the drywall tool by a delivery hose that shoots water into the interior of the drywall tool to clean compounds out of its interior chambers.

U.S. published application no. 2005/0273957 relates to a "Cleaning Apparatus" for washing eating utensils. The cleaning apparatus includes a housing and a pair of brushes that are positioned on opposing interior walls of the housing such that the bristles of one brush are close to or overlaying the bristles of the other brush. The base or floor of the housing has an opening that permits water to flow through the housing.

U.S. Pat. No. 4,439,884 relates to a "Container with Bristles for Cleaning Instruments" and discloses a device useful in the medical and dental fields which has an open ended container that has bristles attached to its walls. The '884 container (5) accepts a replaceable support (13) with bristles (6) (see FIG. 5) for periodical cleaning and/or disinfection.

Though prior devices have been used for cleaning cutlery and other instruments, where solvents are used, in some cases, acetone and resin may be absorbed into the bloodstream when the resin/acetone mixture comes in contact with skin, since the acetone dissolves the resin, and the resin may be absorbed into the skin along with the acetone. Though, in some cases, acetone has been replaced with other solvents, it is beneficial to contain the use of the solvent and minimize the contact with individuals.

A need exists for an improved cleaning device that is economical to produce and that can contain and store solvents and be used for carrying out a cleaning process for tools used in the application of resin compounds.

SUMMARY OF THE INVENTION

The present invention provides a cleaning apparatus designed for facilitating the cleaning of tools, and, more particularly, for cleaning resin application tools.

It is an object of the invention to provide a cleaning apparatus that is useful in conjunction with a solvent for cleaning resins, such as, for example, Polyester Resin, from tools that are used to apply resin to a surface or other structure.

It is another object of the invention to provide a cleaning apparatus that includes a container having an opening at the top and is constructed from a material that is resistant to solvents (e.g., such as Bio-Solv®) that may be used for cleaning resin from tools.

Another object of the invention is to provide a cleaning apparatus that has a shelf with slots therein that is provided within the container so that solvent may drain into the area beneath the shelf, where solvent may be stored.

According to a preferred embodiment, the cleaning device has brushes that are situated within the container space to facilitate the cleaning of tools, such as, for example, resin application tools. The brushes aid in abrading the resin from a tool, preferably, in conjunction with the solvent which is held in the container.

According to a preferred embodiment, the cleaning apparatus has a second shelf that is slidably positionable within the container space. The second shelf, for example, may be used as a drying rack on which to rest tools that have been cleaned so they may dry. Also, tools to be cleaned may be set on the second shelf.

Another object of the invention is to provide an apparatus that facilitates the cleaning of resin from tools that has a recovery system that is configured to recover solvent for reuse and permit disposal of the resin substrate removed from the tools, and provide a method for cleaning resin tools that promotes the recovery of solvent and facilitates disposal of resin waste products removed from tools during a cleaning process.

These and other advantages of the invention are provided.

BRIEF DESCRIPTION OF THE DRAWING FIGURES

DETAILED DESCRIPTION OF THE PREFERRED EMBODIMENTS

Figure 1:
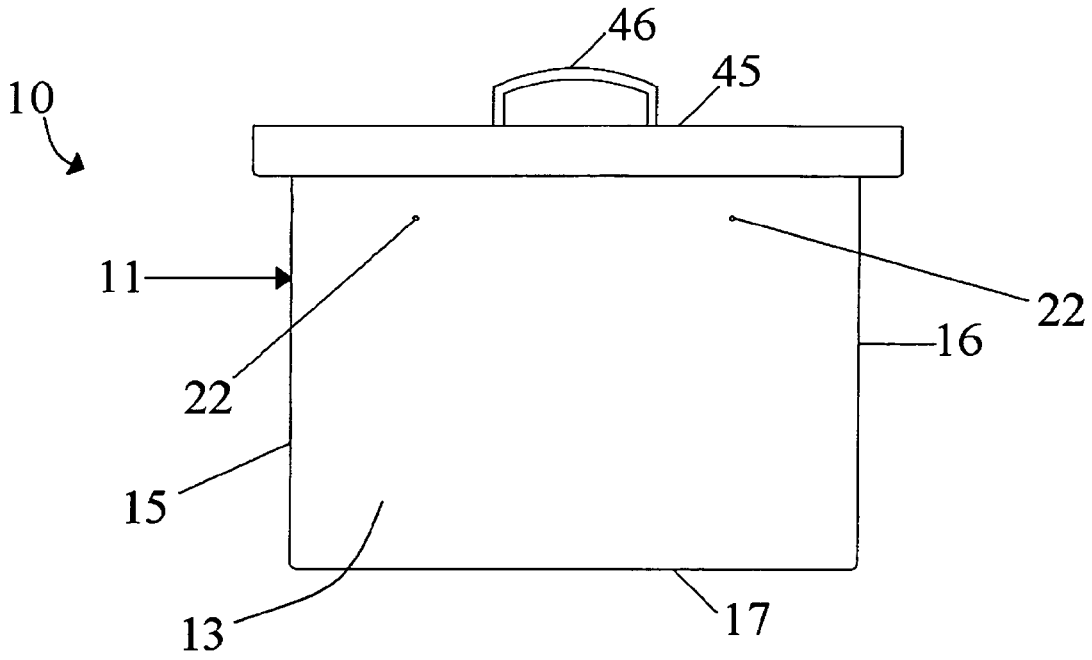
FIG. 1 is a front elevation view of a cleaning station according to a preferred embodiment of my invention.
Figure 2:
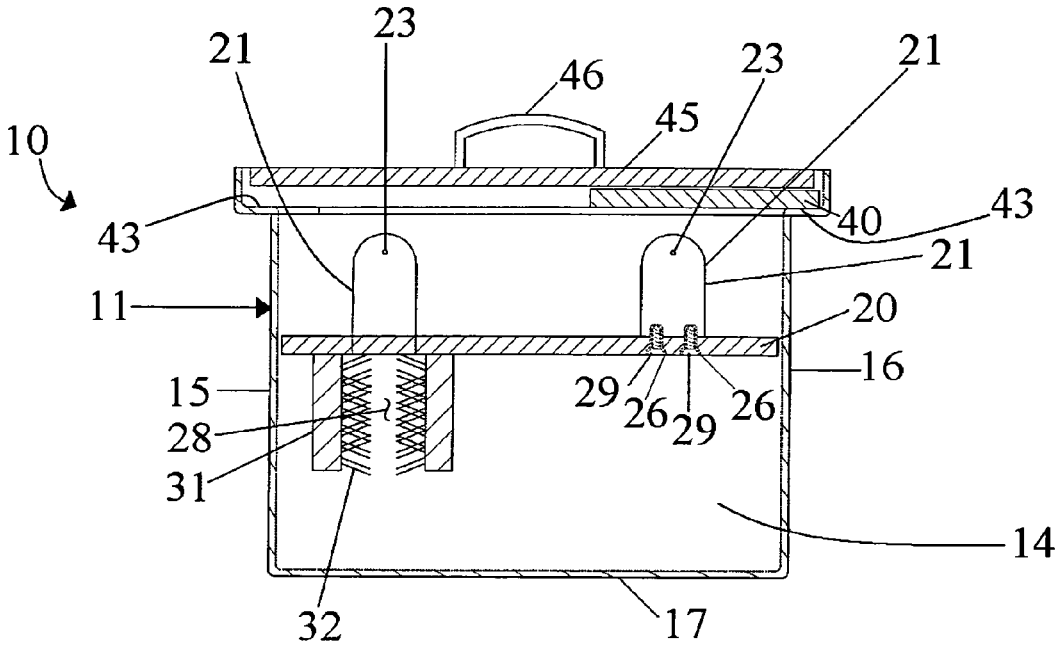
FIG. 2 is a longitudinal sectional view of the cleaning station of FIG. 1, taken through the section line 2-2 of FIG. 4, shown with the cover of FIG. 1.
Figure 3:
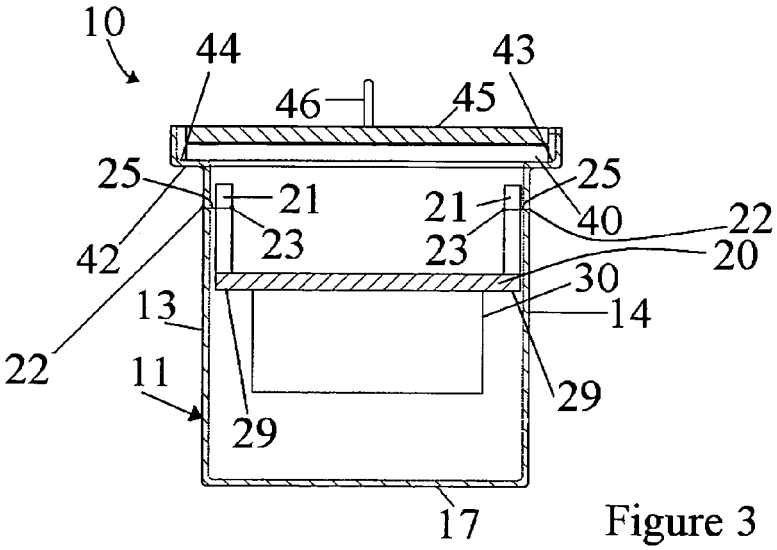
FIG. 3 is a sectional view taken through the section line 3-3 of FIG. 4.
Figure 4:
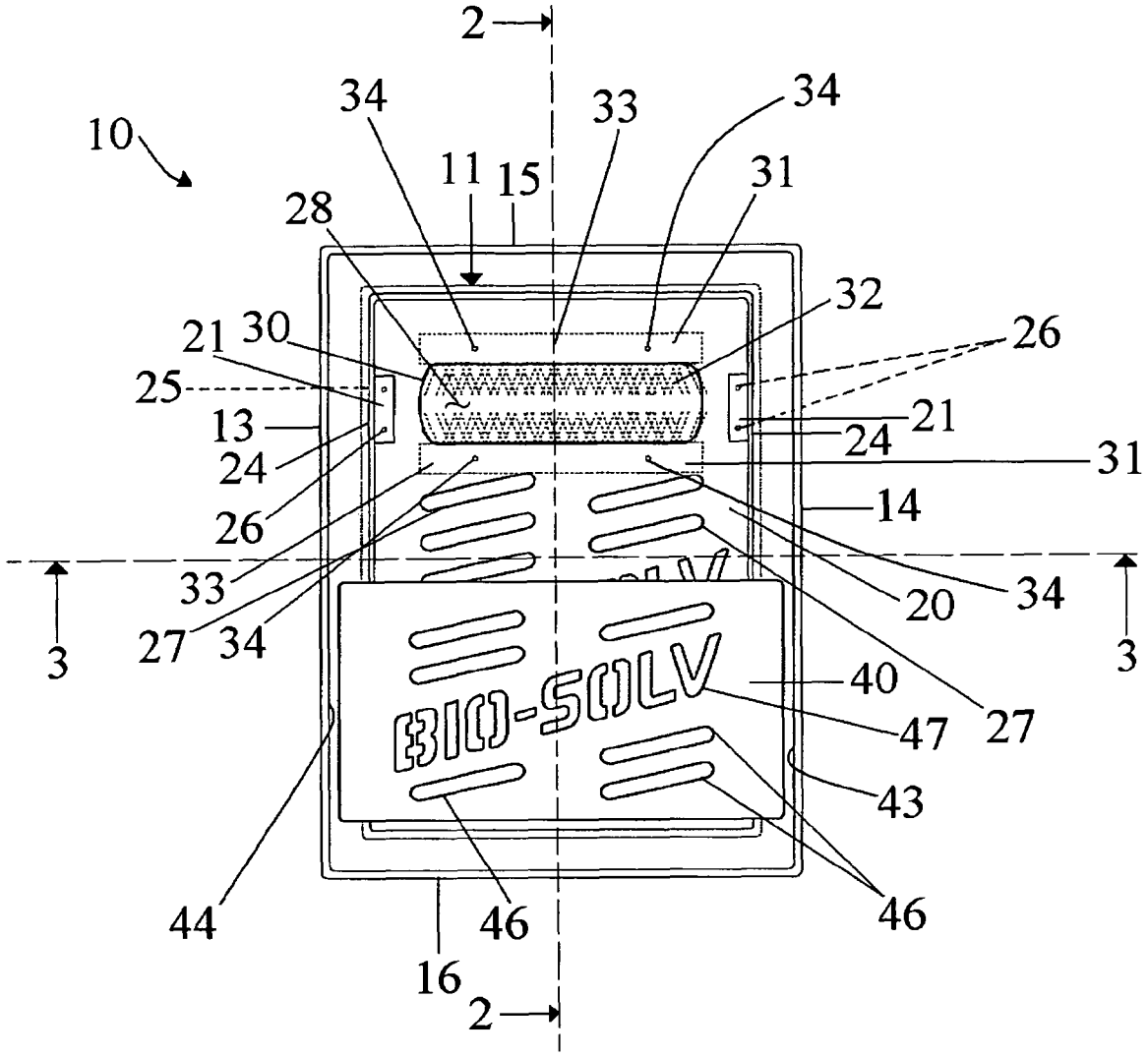
FIG. 4 is a top plan view of the cleaning station of FIG. 1, shown with the cover removed.

Referring to the drawing figures, a preferred embodiment of a cleaning station 10 is illustrated. The cleaning station 10 includes a container 11 having side walls 13, 14, 15 16 and a floor 17. The side walls 13, 14, 15, 16 connect with the floor 17 and define an opening at the top of the container 11. According to a preferred embodiment, the side walls are provided in pairs, with two opposing side walls 13, 14 at each container end being connected with the lateral opposing side walls 15, 16. The cleaning station 10 includes a first shelf 20 that is provided within the container 11. The first shelf 20 preferably is provided at a location above the container floor 17 so that the first shelf 20 is elevated from the container floor 17. The first shelf 20 preferably is secured to the container 11, and according to preferred embodiments, remains at a fixed location within the container 11. According to one embodiment, the first shelf 20 is mounted to the container 11 using a suitable mounting mechanism, such as, for example, the mounting elements 21 shown engaging the first shelf 20 and connecting with the container 11. Preferably, the mounting elements 21 are connected to a side wall, such as the lateral side walls 15, 16. A removable fastening member, such as the wing nut 22 and bolt 23 may be used to secure the mounting elements 21 to the container side walls 15, 16. According to a preferred embodiment, the mounting elements 21 may have a groove 24 therein for holding an edge of the first shelf 20. This permits the mounting elements 21 to be mounted above a location where the solvent fill line is anticipated, thereby minimizing or preventing leakage from the fastening members 22, 23 used to secure the mounting elements 21 to the container 11. Preferably, the bolt 23 may pass through a container side wall 15, 16 to which the mounting element 21 is mounted. Optionally, one or more sealing members (not shown), such as, for example, bushings may be used in connection with the mounting of the mounting elements 21 so the fastening members 22, 23 may secure the mounting elements 21 in a manner that prevents or minimizes any leakage of fluids from the container 11. According to some embodiments, the fastening members 22, 23 may be provided as rivets or permanent fastening components, while according to alternate embodiments, the fastening members 22, 23 may be provided as removable components that are detachable and permit disassembly of one or more components of the device. The fastening members 22, 23, for example, according to a preferred embodiment, alternately may be configured as locking pins, or other suitable fastening elements that allow easy removal of the first shelf 20 for removal of material that has accumulated at the bottom of the tank (such as resin sludge). The configuration with the mounting elements 21 being attached at a location above the first shelf 20 permits the solvent level to be maintained above the surface of the first shelf 20 yet below any mounting holes 25 provided in the side walls of the container 11 thereby preventing leakage of the solvent. The container 11 and first shelf 20, according to a preferred embodiment, may be constructed from a polyethylene material. Preferably, the mounting elements or legs 21 are connected to the first shelf with suitable fastening members, such as the screws 29 which may be fastened through the first shelf 20 into the leg 21 (see FIG. 2). The screws 29, for example, may be machine type screws that are provided to fit within a threaded bore 26 of the leg 21, or, alternately, may be self-tapping screws that form the bore 26 when installed. Although two screws 29 are illustrated, other numbers of screws may be used. Also, the screws are illustrated in connection with on of the legs 21, but although not shown, the screws 29 may be provided to connect the other legs 21 with the first shelf 20. Other suitable fastening members may be used to secure the legs 21 with the first shelf 20.

According to a preferred embodiment, the first shelf 20 is shown held with four mounting elements, which according to a preferred embodiment are shown configured as the legs 21. Preferably, a plurality of openings 27 are provided in the first shelf 20. The openings 27 permit passage of material through the first shelf 20, and preferably allow the passage of solvent and tool resin substrate to pass from above the first shelf 20 (i.e., the working section) to the area below the first shelf (the settling section). According to a preferred embodiment, as illustrated in the drawings, the openings 27 are configured as diagonally disposed slots to facilitate the transition of the catalyzed resin, dirt and fiberglass strands that may pass from the upper or working section of the container 11 (above the first shelf 20) to the lower or settling section of the container 11 (below the first shelf 20).

According to preferred embodiments, the first shelf 20 preferably is disposed at a level of about ⅓ from the top of the container 11, so that about ⅔ of the container height is below the first shelf 20. Though this is a preferred arrangement, other suitable configurations may be utilized.

The first shelf 20 preferably is provided with at least one opening therein 28 that accommodates a cleaning mechanism 30. According to a preferred embodiment, the cleaning mechanism 30 has a pair of brushes 31 that are mounted in opposing relationship in the opening 28. The brushes 31 are illustrated in a slightly overlapping relationship in the drawings figures, however, although not shown, according to an alternate configuration, the brushes 31 may be spaced apart from each other so that the ends of the brushes are separated by a space. The brushes 31 preferably are constructed from a material that is compatible with the solvent being utilized for cleaning. The brushes 31 preferably may be provided having bristles 32 that are designed to facilitate engagement with the surface of objects brought into contact with the bristles 32, such as, for example, tools. The bristles 32 preferably are attached to a mounting structure 33 which may be mounted to the first shelf 20 with suitable fastening elements, such as for example the stainless steel screws 34, bolts, rivets or other suitable means. Preferably, the brushes 31 are mounted so that the tools may engage the brushes 31 when the tools are placed within the opening 28. The lower portion of the container 11 that is below the first shelf 20 may serve as the reservoir to hold a solvent that may be used for cleaning objects, such as, for example, tools. Preferably, the cleaning station 10 is provided to facilitate cleaning of resin application tools, and more particularly, to facilitate loosening of compound from the tools with the brushes 31 and with the aid of a solvent that may be used in conjunction with the brushes 31.

The cleaning station 10 preferably has a second shelf 40 that is provided in the container 11. The second shelf 40 preferably is located above the first shelf 20 and is movably mounted in the container. According to a preferred embodiment illustrated in the figures, the first shelf 20 is provided between the opposite adjacent walls 13, 14. Preferably, the second shelf 40 is provided to have a length that is smaller relative to the length of the interior of the container 10 (that is, the lateral container dimension as measured between the adjacent side walls 13, 14). This preferred configuration permits the second shelf 40 to be positioned at a range of locations. A mounting mechanism 42 for securing the second shelf 40 is provided. The mounting mechanism 42, according to a preferred embodiment, is configured having a pair of lateral ledges 43, 44 provided on the lateral side walls 15, 16 of the container 11. The second shelf 40 preferably is supported on the ledges 43, 44 and may be slidably moved along the ledges from one end of the container 11 to the other (e.g., between the adjacent side walls 13, 14). The ability to position the second shelf 40 facilitates the utilization of the cleaning station 10 by being able to position the second shelf 40 to hold tools for drying while the brushes 31 are exposed for use, as well as being able to position the second shelf 40 over the brushes so that the portion of the first shelf 20 may also be used for holding tools. Preferably, the second shelf 40 is removably provided for facilitating cleaning of the second shelf 40, or to make use of the first shelf 20 for larger sized or uniquely shaped tools that may require additional space in the container 11 when they are being cleaned. According to a preferred configuration, the second shelf 40 has a plurality of slots 46 therein, which in the embodiment illustrated are diagonally disposed. Additionally, a logo slot 47 may be provided, and may be used to display a logo, name, symbol or other indicia. The indicia may be provided to identify a type of cleaning station, a brand, a use or to distinguish one cleaning station 10 from another.

According to preferred embodiments, the cleaning station 10 is provided with a cover 45 that is configured to cover the container opening 18. The cover 45 covers the opening of the container 11 to prevent dust and dirt from entering the container 11 and to reduce evaporation of the solvent when the cleaning station 10 is not in use. The cover 45 is shown in a preferred configuration having a handle 46 that is provided on the exterior of the cover 45 to facilitate removal and installation of the cover 45 on the container 11. The cover 45 preferably may have a sealing element (not shown) for sealing the cover with the top perimeter of the container side walls 13, 14, 15, 16. The sealing element, for example, may be a gasket, o-ring, or other suitable sealing component, and preferably is made from a material that is resistant to degradation by the solvents and materials that are anticipated being used in connection with the cleaning station 10. The cover 45, according to a preferred embodiment, may be constructed from a polyethylene material.

Preferably, the cleaning mechanism 30 is disposed in a location relative to the first shelf 20 so that the cleaning mechanism 30 aligns with at least one opening of said first shelf 20, such as the opening 28 that is designed to receive the cleaning mechanism 30. Preferably, the second shelf 40 is disposed at a height in the container higher in relation to the first shelf 20, and the second shelf 40 is positionable at least one location that is a location that is spaced from the cleaning mechanism 30 to provide access to said cleaning mechanism 30 to facilitate introduction of tools to the cleaning mechanism 30.

The cleaning station 10 may be used with a solvent. According to a preferred method of using the cleaning station 10, the solvent may be provided in an amount that covers the brushes 31 and/or first shelf 20. The solvent preferably may be Bio-Solv® (an acetone replacement solvent) that may be dispensed into the container 11. The cleaning station 10 cover 45 may be installed over the opening 18 so the solvent contained in the cleaning station may be stored and reused. The cover 45, when used, also prevents or minimizes evaporation of the solvent during storage. The cleaning station 10 second shelf 40 may be used for resting tools when the tools are drying. The second shelf slots 46 preferably may allow drainage of solvent from tools to pass through.

Throughout the cleaning process, the second shelf 40 may be adjustably positionable by sliding it along the ledges 41 disposed on each lateral side wall 15, 16 of the container 11. Preferably, the tools to be cleaned are brought into contact to engage the brushes 31 and the tool is moved relative to the brushes 31 so that the bristles 32 abrade the material from the tool. During the cleaning process, the tool may be lowered below the brushes 31 and into the solvent that is in the reservoir at the bottom of the container 11. The tools may be lowered to pick up solvent from the bottom of the container 11 as needed, and then brushed with the brushes 31. This may be repeated until the material from the tool is removed from the tool or the tool is cleaned to a desired condition. According to a preferred embodiment, the solvent is provided to be compatible with the substrate on the tool to be removed from the tool. For example, one preferred embodiment involves the brushing of the resin material from the tool so the material is received into the bottom of the container 11 occupied by the solvent. Where the method utilizes a solvent, such as, for example, Bio-Solv® (a registered US trademark of Phoenix Resins, Inc.), the resin substrate may form with the solvent a material. The material may be liquid or viscous, and may be stored within the container 11, preferably with the cover 45 in place. When the suitable amount of substrate has been removed from tools, whether over one cleaning, or over a period of time after several tool cleanings, then the solvent and substrate resin mixture may be removed from the container 11. According to a preferred embodiment, the first shelf 20 also is removably provided so that the first and second shelves 17, 40, respectively, may be removed from the container 11. This permits access to the solvent and substrate contents, and the solvent and substrate mixture may be removed from the container 11. The solvent and substrate mixture may be set aside for drying. When dry, the solvent, such as Bio-Solv® and substrate, in this example, forms a substantially solid material that may be broken up for ease of disposal. The use of the cleaning station 10 facilitates the method wherein the solvent may be contained and used to take up the substrate that is removed from the tool, and the disposal of the substrate material may be effected without the need for hazardous solvent disposal, since the debris is substantially a solid material. The cleaning station 10 may permit the use of the brushes and storage of solvent and removed substrate to effect a concentration of the solvent to substrate composition that will provide a solid disposal product.

The method of cleaning tools to provide a solid disposal by product is provided. The method is carried out using the cleaning station 10. The cleaning station 10 provides for removal of the debris from the tool in a manner that facilitates the collection of the material and permits the reuse of the solvent. At the end of the cleaning process, the solvent and substrate material that has been removed from the tools may be dried and disposed of as a solid product. Preferably, the solvent is poured off from the container 11 to leave behind the "sludge" which is formed from the catalyzed resin, glass fibers and other contaminants that settle out of the solution at the bottom of the container 11. The solvent liquid can be poured off and reused. The solvent may be transferred to a second cleaning station 10 for reuse. The sludge (along with any solvent left behind) will form a hardened solid form. This reduces or eliminates hazardous waste and allows the recycling of the liquid solvent, such as Bio-Solv®.

The configuration of the cleaning station 10 provides a solvent reservoir that is accessible during cleaning of the tools, yet the cleaning station 10 is configured so that material that is removed from the tools during the cleaning process substantially is delivered to the solvent compartment or reservoir and stored there until it may be disposed of. The disposal procedure may be carried out with the cleaning station 10. One disposal method involves pouring off the mixture through a plurality of openings provided in the first shelf 20. Another method involves the removal of the first shelf. In the former method, the first shelf 20 may remain installed. In the latter method, the first shelf may be removed and the mixture permitted to dry in the bottom of the container 11, preferably, by first removing any excess solvent that is present (for reuse). Accordingly, though it is preferred to have a lower level of material to facilitate drying of the resin components left behind from the cleaning process, the material from one container 11 may be transferred to a second or other container 11 so that drying of material may be accumulated.

The container 11 holds the solvent, and preferably is divided into two sections, an upper section (or working section) where the tools can be cleaned, scrubbed and agitated with minimal disturbance to a lower section (the settling section) where the catalyzed resin, fibers and dirt (sludge) will settle out.

While the invention has been described with reference to specific embodiments, the description is illustrative and is not to be construed as limiting the scope of the invention. Various modifications and changes may occur to those skilled in the art without departing from the spirit and scope of the invention described herein and as defined by the appended claims.

What is claimed is:

1. A cleaning station comprising:

a container having a floor and two pairs of side walls connected to form an enclosure;

a first shelf disposed at a location elevated in relation to said container floor, wherein said first shelf is fixed in position;

a second shelf removably provided for disposition at a location above said first shelf, said second shelf being slidably positionable over the length of the container and being slidable independently over said first shelf, wherein said second shelf is smaller relative to the width of the container between at least one pair of side walls so as to slidably positionable between said side walls;

said first shelf having a plurality of openings therein that permit the area above the first shelf to communicate with the area below the first shelf;

said first shelf having an opening that contains a cleaning mechanism; wherein said cleaning mechanism comprises a pair of brushes that are secured in opposing relation; and a pair of lateral ledges provided on the other of the at least one pair of side walls that said second shelf slides relative, wherein said lateral ledges support the second shelf to permit the second shelf to slide along the lateral ledges, said second shelf being in sliding engagement with said lateral edges.

2. The device of claim 1, wherein said second shelf has a plurality of openings provided therein.

3. The device of claim 2, wherein said openings comprise slots.

4. The device of claim 2, wherein the container has an opening at the top thereof, and further including a lid that is configured to cover said container opening.

5. The device of claim 1, wherein said container and said first shelf are constructed from polyethylene.

6. The device of claim 1 further comprising a removable cover.

7. The device of claim 1, further comprising a removable cover, wherein the removable cover includes a sealing element for sealing the cover with at least one side wall of the container.

8. The device of claim 1, wherein the first shelf is mounted to the container with mounting elements, wherein said mounting elements secure said first shelf in a fixed position, and wherein said mounting elements are releasable to release said shelf from its fixed position.

9. A method for cleaning resin application tools for facilitating disposal of cleaning debris and promoting the availability of cleaning solvent for reuse, including:

a) providing the cleaning apparatus of claim 1;

b) providing a solvent for facilitating the removal of resin from tools;

c) placing the solvent in the container;

d) lowering a tool through the cleaning mechanism to contact the solvent in the container;

e) bringing the tool into contact with the cleaning mechanism to effectuate the removal of resin from the tool and allowing resin debris to settle in the container;

f) repeating as necessary one or the other or both of steps d) and e) to effectuate the further removal of resin from the tool;

g) recovering solvent from the container by separating the solvent from the resin debris in the container; and h) drying the resin debris from step g.

* * * * *